United States Patent [19]

Tsuda et al.

[11] 4,223,993

[45] Sep. 23, 1980

[54] ELECTROPHOTOGRAPHIC APPARATUS

[75] Inventors: Hiroshi Tsuda, Mitaka; Kiyoshi Miyashita, Hachioji, both of Japan

[73] Assignee: Olympus Optical Co., Ltd., Tokyo, Japan

[21] Appl. No.: 51,519

[22] Filed: Jun. 22, 1979

[30] Foreign Application Priority Data

Jun. 27, 1978 [JP] Japan ..... 53-76940

[51] Int. Cl.[3] ..... G03G 15/00

[52] U.S. Cl. ..... 355/3 R; 271/311; 271/DIG. 2; 355/3 SH; 355/3 TR

[58] Field of Search ..... 355/3 R, 3 SH, 3 TR; 271/DIG. 2, 311, 313, 307

[56] References Cited

U.S. PATENT DOCUMENTS

| | | | |
|---|---|---|---|
| 3,912,256 | 10/1975 | Nagahara | 271/DIG. 2 |
| 4,072,307 | 2/1978 | Knieser | 271/DIG. 2 |

*Primary Examiner*—R. L. Moses

*Attorney, Agent, or Firm*—Haseltine, Lake & Waters

[57] ABSTRACT

An electrophotographic apparatus comprising a charge retentive drum such as a photosensitive drum including an electrically conductive drum substrate and a charge retentive layer applied on the drum substrate, a developing device for developing an electrostatic latent image formed on the drum with toner to form a toner image, a transfer roller for transferring the toner image onto a record paper, the record paper being fed between the drum and the transfer roller, a peelling claw for peeling the record paper having the toner image transferred thereto off the drum surface, the peeling claw being made of conductive metal and its free end being urged against a depressed edge portion of the conductive drum substrate, and means for connecting the peeling claw to the earth potential.

11 Claims, 7 Drawing Figures

ELECTROPHOTOGRAPHIC APPARATUS

BACKGROUND OF THE INVENTION

This invention relates to an electrophotographic apparatus comprising an electrostatic charge retentive drum which includes a drum-shaped substrate made of electrically conductive material and a charge retentive layer applied on the surface of the drum-shaped substrate, means for transferring a toner image formed on the charge retentive layer onto a record carrier and means for peeling the record carrier from the charge retentive layer after the toner image has been transferred thereon.

Various electrophotographic apparatuses of the above mentioned kind have been proposed and realized. The applicant has also developed an electrophotographic apparatus comprising a photosensitive drum which includes a rotating drum substrate made of metal and a photosensitive layer applied on the drum, means for forming an electrostatic charge image on the drum, means for developing the charge image with toner to form a toner image, means for transferring the toner image onto a record paper and means for fixing the transferred toner image on the record paper. In such an apparatus the photosensitive drum should have the following functions;

(1) the toner image of excellent quality can be formed, (2) the toner image can be transferred efficiently without deteriorating the toner image, (3) the record paper which is fed with being in intimately contact with the drum can be positively peeled off, (4) the photosensitive drum can be easily exchanged.

Heretofore various methods for peeling the record paper off the drum have been known. The most simple and positive method is to use a peeling claw. In order to peel the record paper off the drum much more positively it has been also known to form a recess or depressed portion on the drum surface along a trajectory of the peeling claw and a free end of peeling claw is inserted in the recess, so that the end of peeling claw can be positively positioned underneath the record paper. That is to say the free end of peeling claw creeps under a front surface of the record paper on which surface the toner image has been transferred.

On the other hand in order to obtain stably a duplicated image of good quality the electrically conductive drum substrate should be always maintained at the stable earth potential. For instance, in a Japanese Patent Laid-Open Publication No. 74,234/73 on respective sides of the photosensitive drum are secured flange members made of metal and these flange members are journaled on a stationary shaft made of metal by means of ball bearing members also made of metal. In such an apparatus the drum substrate is electrically connected to the earth potential through the flange members, bearing members and stationary shaft. Further the photosensitive drum is driven by a pin-clutch hole engagement, the pin being secured to a driving gear arranged coaxially with the shaft and the hole being formed in one of the flange members. Upon exchanging the photosensitive drum it is necessary to withdraw the dram assembly along the stationary shaft. During this withdrawing operation the bearing member secured to the flange member slides on the stationary shaft.

In the above mentioned known photosensitive drum assembly since the stationary shaft and bearing member have to be made of metal and thus the bearing member does not smoothly slide on the shaft and particularly when the apparatus has been remained inoperative for a relatively long time the flange and bearing members and/or the bearing member and stationary shaft, respectively might be fastened to each other with rust. As a result thereof the earth potential on the conductive drum might be unstable and the exchange of the drum becomes very difficult. Moreover since the flanges and bearings are made of metal they are very heavy and thus the photosensitive surface of drum is quite liable to be injured during the exchange thereof. The flange and driving gear are made as separate bodies and have complicated construction. From the view point of economy they could not be manufactured as an integral body of metal.

SUMMARY OF THE INVENTION

The present invention has for its object to provide a novel and useful electrophotographic apparatus which can avoid the above mentioned various drawbacks of known apparatus and can maintain always the charge retentive drum at the stable earth potential and thus can form a toner image of excellent quality on the charge retentive drum as well as on record carriers.

It is another object of the invention to provide an electrophotographic apparatus comprising a charge retentive drum assembly which is simple in construction, light in weight and can be easily exchanged without injuring the charge retentive drum surface.

According to the invention on electrophotographic apparatus comprises an electrostatic carge retentive drum arranged rotatably about its axis and including a drum-shaped substrate made of electrically conductive material and a charge retentive layer applied on the drum substrate;

means for transferring a toner image formed on the charge retentive layer onto a record carrier, while the record carrier is fed with being made into intimately contact with the charge retentive drum surface;

at least one peeling claw for peeling the record carrier off the drum after the toner image has been transferred onto the record carrier and made of electrically conductive material, said peeling claw being urged against one side edge portion of the drum substrate of the charge retentive drum; and means for connecting the peeling claw to the earth potential so as to connect conductively the drum substrate to the earth potential via the peeling claw.

DESCRIPTION OF THE PREFERRED EMBODIMENTS

Figure 1:
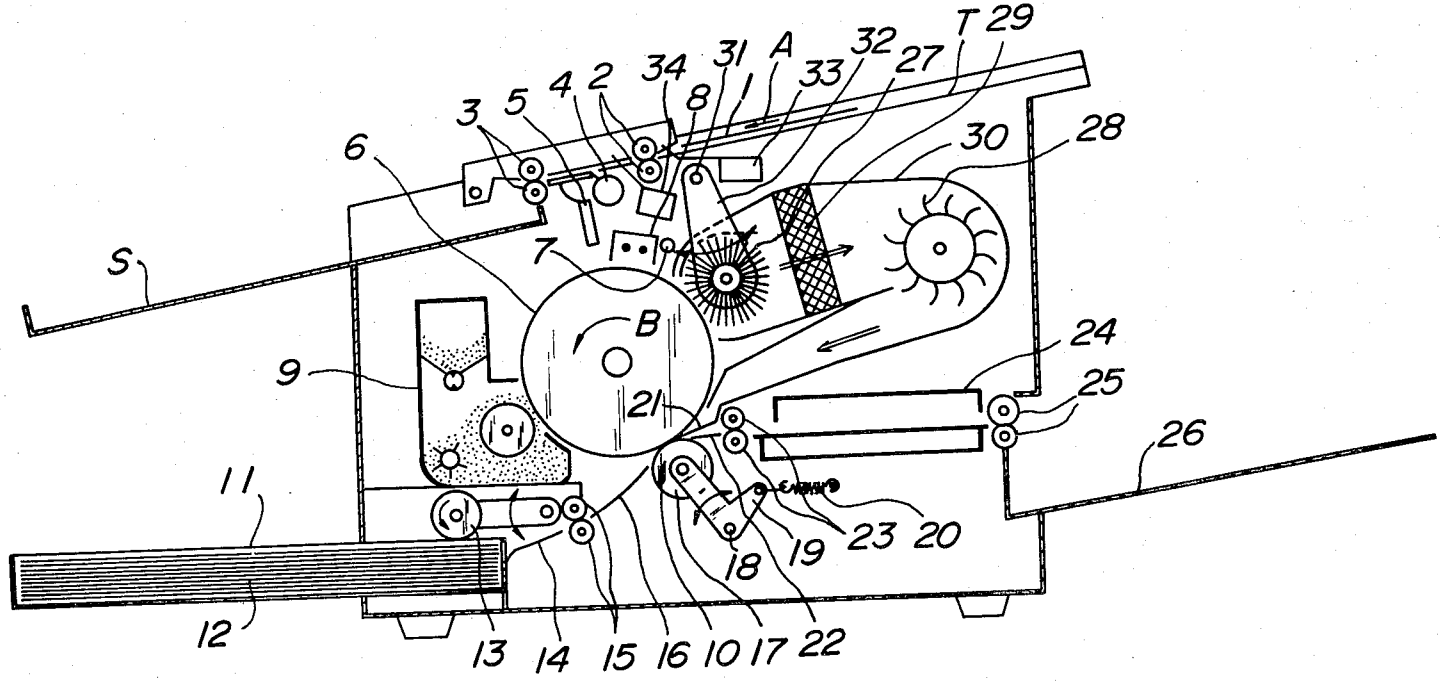
FIG. 1 is a schematic view showing an embodiment of an electrophotographic apparatus according to the invention.

FIG. 1 is a schematic view showing an embodiment of an electrophotographic apparatus according to the invention. A document 1 to be duplicated is placed on an inclined document table T and is inserted into a document feed device in a direction shown by an arrow A. The document feed device comprises feed rollers 2 and 3. During the travelling through the feed device the document 1 is illuminated by a lamp 4 and an image of document is projected by means of an optical system 5 onto a photosensitive drum 6 rotated at a constant speed in a direction of an arrow B. The drum 6 is first subjected to a charge erasing lamp 7 and is then uniformly charged by a corona charger 8. Upon the projection of the document image on the drum 6, an electrostatic latent image corresponding to the document image is formed thereon. The latent image is developed with toner in a toner developing device 9 to form a visible toner image. The toner image thus formed is fed to a transfer section 10. On the other hand record papers 11 installed in a paper cassette 12 are picked-up one by one by means of a rotating and swinging pick-up roller 13 and are fed to the transfer section 10 via a paper guide 14, register rollers 15 and a paper guide 16. In the transfer section 10 the record paper is fed between the drum 6 and a semiconductive transfer roller 17 to which a transferring bias voltage is applied and the toner image on the drum 10 is transferred onto a record paper 11. The transfer roller 17 is journaled at one end of an arm 19 which is rotatable about an axis 18. The other end of the arm 19 is connected to a spring 20. When the record paper 11 is fed to the transfer section 10 the transfer roller 17 is urged against the drum 6 by a force of the spring 20, otherwise the roller 17 is kept apart from the drum 6 by means of a solenoid not shown. The record paper 11 having the transferred toner image thereon is separated from the drum surface with the aid of a peeling claw 21 and an air stream. Then the record paper 11 is further fed by feed rollers 23 to a fixing device 24 of an over heater type in which the toner image is fused onto the surface of the paper. The final copy thus obtained is discharged by discharge rollers 25 onto a copy tray 26. The document 1 is discharge on a document tray S.

The toner image is not wholly transferred onto the record paper 11, but is partly remained on the drum 6 after the transfer and residual toner is erased by a rotating cleaning brush 27. Toner particles brushed off the drum 6 are collected by a filter 29 with the aid of an air stream produced by a fan 28. The brush 27, fan 28 and filter 29 are installed in a duct 30 so as to produce the sufficiently strong air stream. In this embodiment this air stream is also used for peeling the record paper 11 off the photosensitive drum 6. Further in this embodiment a number of copies can be formed from the same and single charge image once formed on the drum 6 by repeating the developing and transferring operations. For this purpose the charge image should be retained on the drum 6. Therefore the cleaning brush 27 is journaled to an arm 32 which is swingable about an axis 31. During the copying operation of retention mode the brush 27 is remained to be separated from the drum 6. Further the document feed device comprises a pair of document detectors 33 and 34 arranged on respective sides of the document feed rollers 3 and synchronous operation of various parts is controlled by document detection signals supplied from these detectors 33 and 34.

In the electrophotographic apparatus described above in order to electrify uniformly the photosensitive drum 6 by the corona charger 8 and to transfer to toner image formed on the drum 6 onto the record paper 11 in an efficient manner it is necessary to maintain an electrically conductive substrate of the drum 6 at the stable earth potential. Further the record paper should be peeled off the drum 6 after it has passed through the transfer section 10. Moreover upon exchanging or repairing the drum 6 it is preferable or necessary to pull the drum 6 out of the apparatus along a direction perpendicular to a plane of the drawing, i.e. an axial direction, because many parts are arranged around the drum 6.

Figure 2:
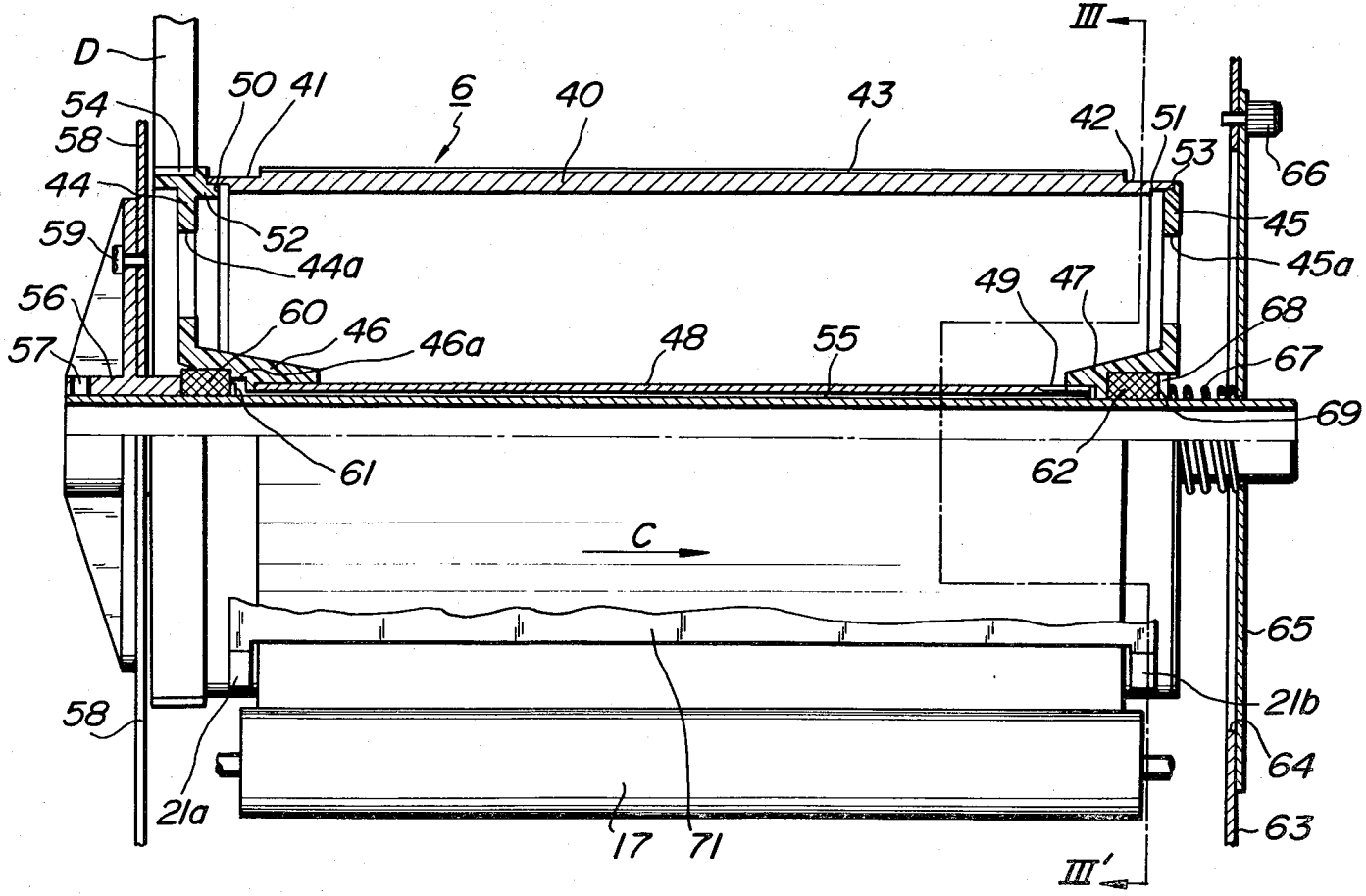
FIG. 2 is a cross sectional view illustrating a photosensitive drum assembly of the apparatus shown in FIG. 1.
Figure 3:
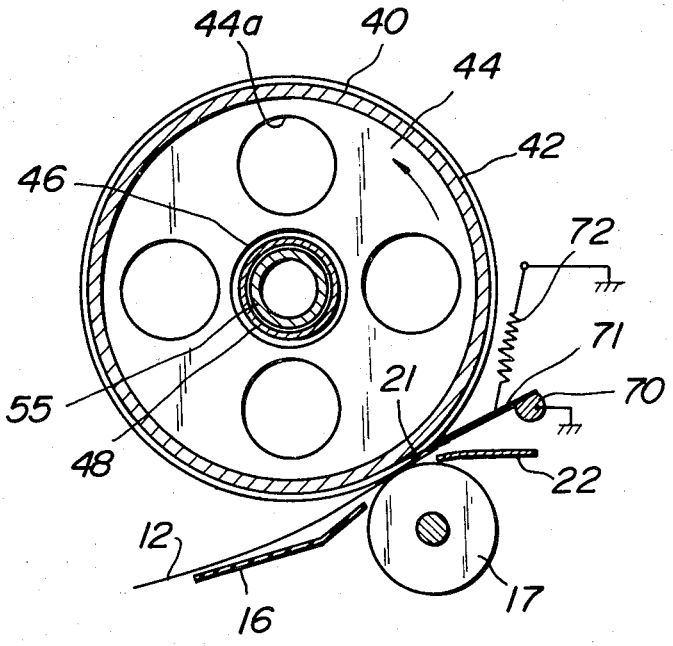
FIG. 3 is a cross sectional view cut along a line III—III in FIG. 2.

In order to satisfy the above requirements according to the invention the drum 6 and peeling claw 21 are constructed in the manner shown in FIGS. 2 and 3. The photosensitive drum 6 comprises an electrically conductive cylindrical substrate 40 made of metal such as aluminium and having formed at its both peripheries stepped or depressed portions 41 and 42 a diameter of which is slightly smaller than that of the remaining portion, and a photosensitive layer 43 made of Se, CdS, organic semiconductor material, etc. are applied on the remaining portion of the cylindrical substrate 40. To both sides of the drum substrate 40 are secured side plates 44 and 45, respectively made of electrically insulating material such as plastics. The side plates 45 and 46 have formed integrally therewith supporting flanges 46 and 47, respectively extending in the axial direction of drum 6. These flanges are coupled to each other by means of a guide tube 48 made of metal or plastics. One end of the guide tube 48 is fixedly secured to the flange 46, but the other end of the guide tube 48 is screwed to the flange 47 by means of a threaded portion 49. In inner surfaces of both side edges of the drum substrate 40 are further formed stepped portions 50 and 51, respectively into which are inserted stepped portions 52 and 53 formed in peripheries of the side plates 44 and 45, respectively. On an outer periphery of the side plate 44 is formed integrally therewith a driven gear 54 which engages with a driving member such as a driving gear D.

In the supporting tube 48 is inserted a fixedly arranged shaft 55 which is sometimes referred as a stationary shaft. A supporting member 56 is inserted into one end of the shaft 55 and is secured thereto by a screw 57. The supporting member 56 is then secured to a frame 58 of the apparatus by means of a screw 59. Between the stationary shaft 55 and the supporting flange 46 is arranged a bearing member 60 made of plastics such as Rulon (trade name of Dixon Company, U.S.A.). Axial movement of the bearing member 60 is limited by the supporting member 56 and a stopping ring 61. Between the supporting flange 46 and the bearing member 60 is arranged a known mechanism for inhibiting relative rotation, but allowing relative movement in the axial direction. A similar bearing member 62 made of plastics is secured to the flange 47 and the stationary shaft 55 is inserted into the bearing member 62. The bearing member 62 may be integrally formed with the side plate 45 together with the flange 47.

In order to withdraw the draw 6 from the apparatus an opening 64 having a diameter slightly larger than that of the drum 6 is formed in a frame 63 and this opening is covered by a detachable cover 65 secured to the frame 63 by a fitting screw 66. In order to support the stationary shaft 55 a free end of shaft 55 is projected beyond the cover 65 and a spring 67 is inserted between the cover 65 and a thrust washer 68 so as to press the drum 6 toward the left direction in FIG. 2. In this manner the axial movement of the drum 6 is limited by an abutment surface 46*a* between the flange 46 and the bearing member 60 and a contacting surface 69 between the bearing member 62 and the washer 68.

As shown in FIG. 3 a pair of peeling claws 21*a* and 21*b* are made of conductive material and are secured to a conductive plate 71 which is rotatably arranged around a conductive axis 70. To the conductive plate 71 is secured a spring 72 and the peeling claws 21*a* and 21*b* are resiliently urged against the stepped portions 41 and 42 of the conductive drum substrate 40.

In the present embodiment the drum assembly can be simply composed by engaging the drum 6 into the side plate 44 to which the guide tube 48 is secured and then the side plate 45 is screwed into the threaded portion 49 of the guide tube 48 in such a manner that stepped portions 50 and 52, and 51 and 53, respectively are completely engaged with each other. The flange 47 may be coupled with the guide tube 48 by a locking cam mechanism instead of the thread mechanism.

Next an operation for exchanging the drum 6 will be explained. At first the drum assembly must be withdrawn from the stationary shaft 55 in the direction shown by an arrow C in FIG. 2. The fitting screw 66 is unlocked and removed. Then the cover 65, the spring 67 and the thrust washer 68 are removed from the stationary shaft 55. Next fingers are inserted into openings 45*a* formed in the side plate 45, corresponding to openings 44*a* of the side plate 44 and the drum assembly is pulled in the direction C, while the conductive plate 71 is rotated by a suitable mechanism not shown against the force of the spring 72 to separate the peeling claws 21*a* and 21*b* from the stepped portions 41 and 42, respectively. In this manner the drum assembly can be withdrawn in the axial direction from the apparatus through the aperture 64. During this operation the guide tube 48 is slid on the stationary shaft 55 and thus the withdrawing operation can be effected in a very simple and safe manner. It should be noted that the bearing member 60 is remained on the stationary shaft 55.

The drum assembly can be installed in the apparatus by effecting the above operation in the reversed order. In order to make it easy that the flange 46 can smoothly override the bearing member 60 during the insertion of the drum assembly into the stationary shaft 55 a taper is formed in the outer periphery of the flange 46. During this operation the peeling claws 21*a*, 21*b* are remained in the separated position from the drum surface.

During the composition and decomposition of the drum assembly with respect to the apparatus the bearing member 62 made of plastics can smoothly slides on the stationary shaft 55 as compared with the metal-metal contact of the known apparatus. Even if the apparatus is remained inoperative for a long time there will not be produced rust anywhere. The guide tube 48 is provided along substantially whole axial length of the drum 6, the side plates 44, 45 and flanges 46, 47 are made of plastics which is light in weight, the drum assembly can be easily and simply withdrawn from or inserted into the stationary shaft 55 without injuring the photosensitive layer 43. The conductive drum substrate 40 can be stably connected to the earth potential by means of the conductive peeling claws 21*a*, 21*b*, conductive plate 71, conductive shaft 70 and conductive spring 72. Since the peeling claws 21*a* and 21*b* are made resiliently urged against the stepped portions 41 and 42, respectively under a constant pressure by the force of spring 72 the conductive surfaces of the stepped portions are always cleaned by the claws and thus a very stable earth potential can be applied to the conductive drum substrate 40. Therefore the duplicated image of good quality can be formed. Further the tips of the peeling claws 21*a* and 21*b* are situated below a level of the photosensitive layer 43 the record paper can be positively removed from the drum surface.

Figure 4A:
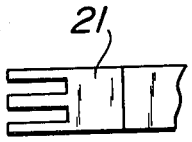
FIGS. 4*a* and 4*b* are plan views depicting two embodiments of a peeliing claw according to the invention.
Figure 4B:
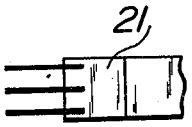
Figure 5A:
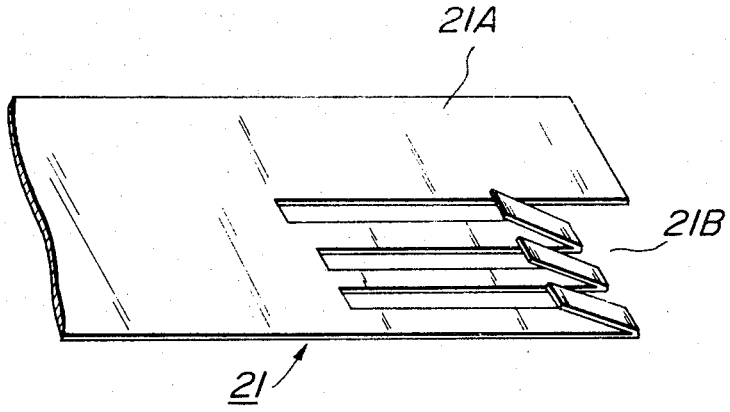
FIGS. 5*a* and 5*b* are perspective view and cross sectional view, respectively illustrating still another embodiment of the peeling claw according to the invention.
Figure 5B:
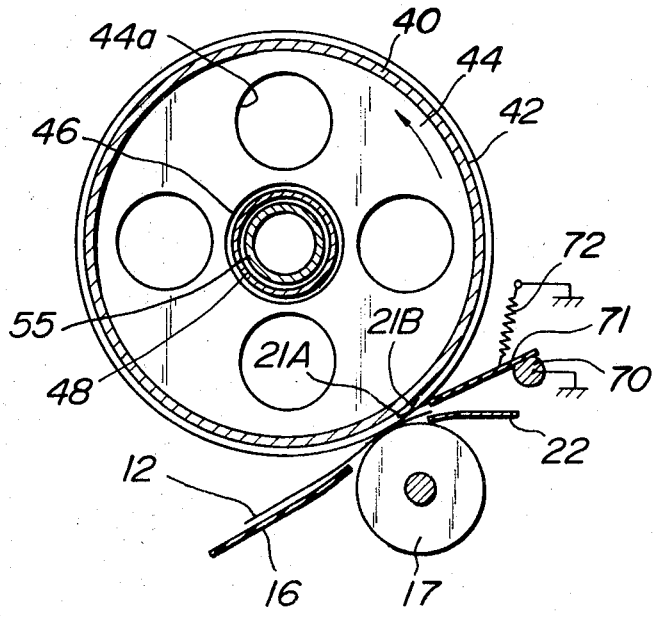

It should be noted that the present invention is not limited to the embodiment explained above, but many modifications can be conceived by those skilled in the art within the scope of the invention. For instance, in the above embodiment the two peeling claws 21*a* and 21*b* are used, but only one peeling claw may be provided. In such a case the stepped or depressed portion may be formed only in one edge portion of the drum substrate 40. Further the depressed portion may be formed as a recess instead of step. In the embodiment the peeling claw is formed as a strip, but it may be formed in various shapes. For instance, as shown in FIGS. 4*a* and 4*b* its tip may be formed as a trifurcated fork or stylus. By means of such construction the conductive connection between the conductive drum substrate and peeling claw can be made further positive. Further as shown in FIGS. 5*a* and 5*b*, the tip of the peeling claw is formed by a peeling portion 21A made of a strip and a contact portion 21B having a trifurcated stylus free ends of which are bent in the rotational direction of the drum 6. Moreover the peeling claw may be made of resilient material. In such a case the spring 72 may be deleted. The present invention can be effectively applied to such a type of electrophotographic apparatus that the charge image formed on the photosensitive member is transferred onto a transfer drum by means of known TESI method or corona ion stream modulation method and the toner image formed on the transfer roller by developing the charge image is transferred onto the record paper by travelling the paper between the transfer drum and the transfer roller.

What is claimed is:

1. An electrophotographic apparatus comprising an electrostatic charge retentive drum arranged rotatably about its axis and including a drum-shaped substrate made of electrically conductive material and a charge retentive layer applied on the drum substrate;

means for transferring a toner image formed on the charge retentive layer onto a record carrier, while the record carrier is fed with being made into intimately contact with the charge retentive drum surface;

at least one peeling claw for peeling the record carrier off the drum after the toner image has been transferred onto the record carrier and made of electrically conductive material, said peeling claw being urged against one side edge portion of the drum substrate of the charge retentive drum; and means for connecting the peeling claw to the earth potential so as to contact conductively the drum substrate to the earth potential via the peeling claw.

2. An electrophotographic apparatus according to claim 1, wherein the drum substrate has formed along its periphery a depressed step portion having a diameter smaller than an outer diameter of the drum, and the peeling claw is urged against said depressed portion.

3. An electrophotographic apparatus according to claim 1, further comprising spring means for urging resiliently the peeling claw against the conductive drum substrate.

4. An electrophotographic apparatus according to claim 1, wherein a free end of said peeling claw is formed as a fork.

5. An electrophotographic apparatus according to claim 1, wherein a free end of said peeling claw is formed as a stylus.

6. An electrophotographic apparatus according to claim 1, wherein said peeling claw comprises a peeling portion made of a strip and an electrical contact portion made of fork or stylus, free ends of which are bent in a direction of the rotation of the drum.

7. An electrophotographic apparatus according to claim 1, further comprising first and second side plates made of electrically insulating material such as plastics and secured to respective sides of the drum substrate, these side plates being formed integrally therewith first and second flanges, respectively extending in an axial direction of the drum;

a guide tube connected between the first and second flanges;

a stationary shaft arranged between first and second frames and removably inserted into said guide tube; and first and second bearing members made of insulating material such as plastics arranged between the first and second flanges and the stationary shaft, respectively; whereby the drum, first and second side plates, flanges and bearing members, and the guide tube are rotated relative to the stationary shaft.

8. An electrophotographic apparatus according to claim 7, wherein one of said frames has formed therein an aperture through which the drum assembly can be withdrawn in the axial direction.

9. An electrophotographic apparatus according to claim 8, wherein the first bearing member facing to said frame having the aperture is secured to the first flange, that the second bearing is so arranged on the stationary shaft that its axial movement is limited, but its rotational movement with respect to the shaft is allowed, and that the second bearing member and second flange have means for allowing relative movement in the axial direction, but limiting rotational movement relative to each other.

10. An electrophotographic apparatus according to claim 9, wherein said first flange and first bearing member are formed integrally with the first side plate.

11. An electrophotographic apparatus according to claim 8, wherein a coiled spring is arranged between the free end of the stationary shaft and the first bearing member so as to push the drum assembly in a direction opposite to the withdrawing direction.

* * * * *